United States Patent [19]

Kamp

[11] 4,175,711

[45] Nov. 27, 1979

[54] DEVICE FOR WITHDRAWING AND TRANSPORTING A WOUND COIL AWAY FROM A WINDING DEVICE FOR TEXTILE FILAMENTS

[75] Inventor: Heinz Kamp, Rickelrath, Fed. Rep. of Germany

[73] Assignee: W. Schlafhorst & Co., Mönchengladbach, Fed. Rep. of Germany

[21] Appl. No.: 788,160

[22] Filed: Apr. 18, 1977

Related U.S. Application Data

[63] Continuation of Ser. No. 626,266, Oct. 28, 1975, abandoned.

[30] Foreign Application Priority Data

Oct. 26, 1974 [DE] Fed. Rep. of Germany ..... 2451001

[51] Int. Cl.[2] ..... B65H 54/20; B65H 54/26

[52] U.S. Cl. ....., 242/35.5 A; 242/41

[58] Field of Search ..... 242/35.5 A, 35.5 R, 242/35.6 R, 18 R, 41; 57/53, 54

[56] References Cited

U.S. PATENT DOCUMENTS

| | | | |
|---|---|---|---|
| 3,480,128 | 11/1969 | Brouwer et al. | 242/35.5 R X |
| 3,572,597 | 3/1971 | Parker et al. | 242/35.5 R X |
| 3,791,126 | 2/1974 | Kose et al. | 242/35.5 A X |
| 3,811,631 | 5/1974 | Mayer et al. | 242/35.5 A X |

FOREIGN PATENT DOCUMENTS

| | | | |
|---|---|---|---|
| 17017 | 9/1966 | Japan | 242/35.5 A |
| 1103267 | 2/1968 | United Kingdom | 242/35.5 A |

*Primary Examiner*—Stanley N. Gilreath
*Attorney, Agent, or Firm*—Herbert L. Lerner

[57] ABSTRACT

Device for withdrawing and transporting a wound coil away from a winding device for textile filaments includes a traveling coil exchanging device for sequentially servicing a plurality of winding devices, the coil exchanging device including coil storage and delivery means for storing therein a coil wound by a respective winding device, the coil storage and delivery means being openable downwardly for discharging the wound coil therefrom.

7 Claims, 1 Drawing Figure

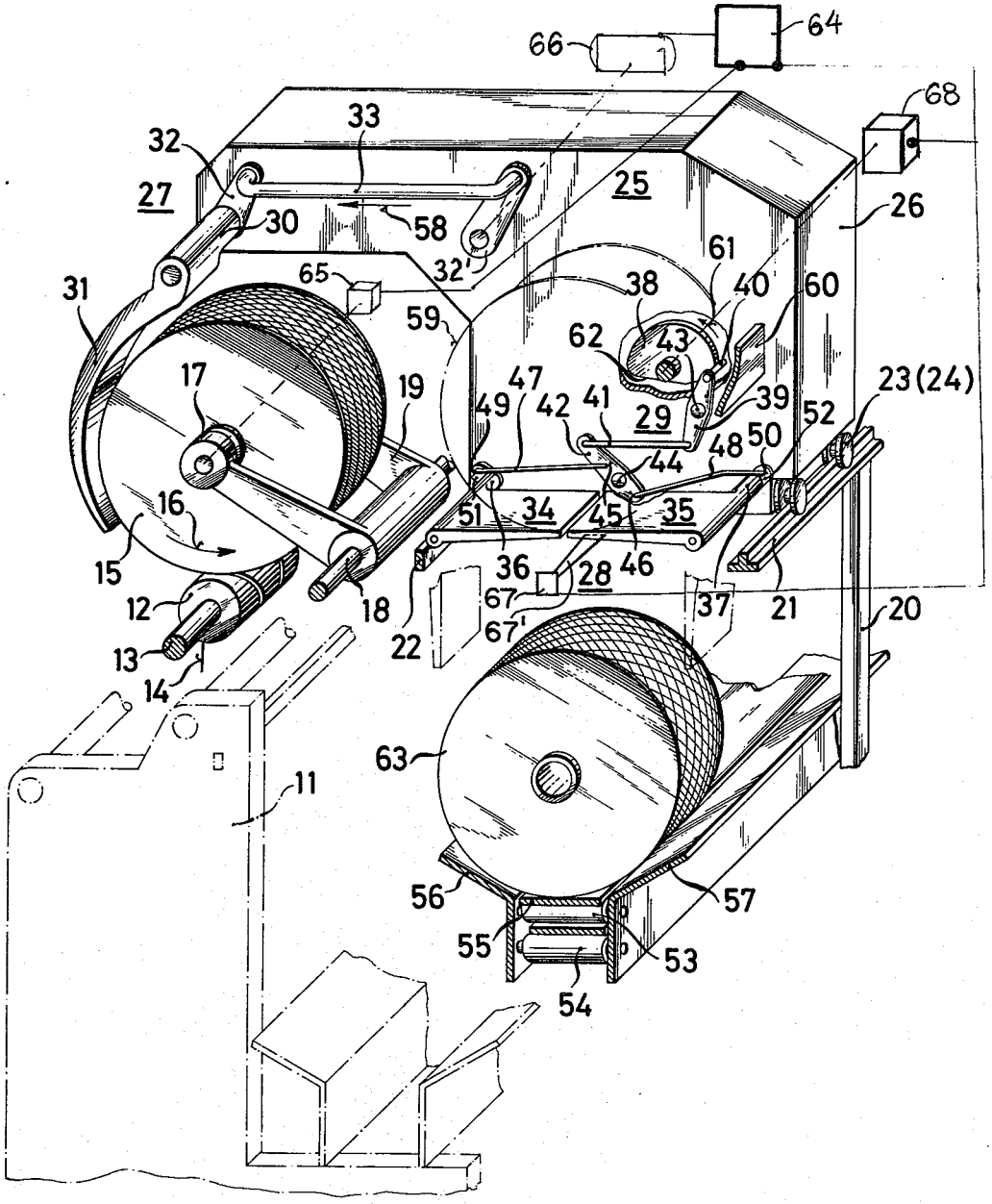
64
66
68
33
32
27
25
26
30
58
61
32'
65
38
40
60
31
59
62
43
17
19
47
42
41
29
39
23(24)
49
52
48
50
44
16
51
34
45
35
15
36
28
46
12
18
67
37
21
20
13
22
67'
14
63
11
56
57
55
53
54

DEVICE FOR WITHDRAWING AND TRANSPORTING A WOUND COIL AWAY FROM A WINDING DEVICE FOR TEXTILE FILAMENTS

This is a continuation of application Ser. No. 626,266, filed Oct. 28, 1975, now abandoned.

The invention relates to a device for withdrawing and transporting a wound coil away from a winding device for textile filaments.

It has been proposed heretofore to provide a coil exchanger carriage servicing a plurality of winding devices which removes a fully wound coil from a respective winding device and places it onto a conveyor belt located laterally adjacent the coil exchanger carriage the conveyor belt then conveying the coils to the end of the textile machine and to a collecting container located thereat.

Due to the fact that the conveyor belt was located laterally adjacent the textile machine, this heretofore known device required an unnecessarily great amount of space.

It is accordingly an object of the invention to provide a device for withdrawing and transporting a wound coil away from a winding device for textile filaments which minimizes the space requirement of the textile machine and ensures undisturbed conveyance of the completely wound coil that is secure against accidents.

With the foregoing and other objects in view there is provided, in accordance with the invention, a device for withdrawing and transporting a wound coil away from a winding device for textile filaments comprising a traveling coil exchanging device for sequentially servicing a plurality of winding devices, the coil exchanging device including coil storage and delivery means for storing therein a coil wound by a respective winding device, the coil storage and delivery means being openable downwardly for discharging the wound coil therefrom.

In accordance with another feature of the invention, the cold storage and delivery means comprise a mechanism for opening the same to discharge the wound coil stored therein, and including a time switch gear or timing mechanism for controlling the opening mechanism.

In accordance with a further feature of the invention means are provided that are actuable by the weight of a wound coil in the coil storage and delivery means for releasing operation of the opening mechanism.

In accordance with an added feature of the invention, the coil storage and delivery means comprise a pair of flaps pivotable downwardly and outwardly in opposite rotary directions.

In accordance with additional features of the invention, the pair of flaps in position thereof wherein a wound coil is stored in the coil storage and delivery means extend substantially in a common horizontal plane, the upper surface of the flaps forming a storage surface for the respective wound coil, the pair of flaps being advantageously inclined toward the middle of the storage surface in the position thereof wherein a wound coil is stored in the coil storage and delivery means.

In accordance with yet another feature of the invention, the coil exchanging device is guided in a given travel direction past the plurality of winding devices, and the withdrawing and transporting device of the invention includes conveyor belt means extending in the given travel direction below the coil storage and delivery means for receiving and transporting away the wound coil discharged from the coil storage and delivery means.

In accordance with a concomitant feature of the invention, the conveyor belt has a conveying speed greater than the speed of travel of the coil exchanging device in the given travel direction.

Heretofore known coil exchanging devices do, in fact, have a storage surface but it does not open downwardly but rather delivers the coil to the rear side of the textile machine.

If the conveying or transporting speed of the conveyor belt is greater than the travel speed of the coil exchanging device, the coils already disposed on the conveyor belt cannot disturb a renewed or repeated coil withdrawing and delivery operation even if no special monitoring means are provided.

Advantages of the invention of the instant application are especially that the conveyor belt is mounted within the lateral profile of the textile machine and requires no additional space. Danger of accident is thereby also minimized because the rear wall of the textile machine no longer possesses any projecting parts and can be covered very readily by a protective screen.

Other features which are considered as characteristic for the invention are set forth in the appended claims.

Although the invention is illustrated and described herein as embodied in a device for withdrawing and transporting away a wound coil from a winding device for textile yarns or threads, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a perspective view of the device for withdrawing and transporting away a completely wound coil from a winding device for textile yarns or threads in accordance with the invention.

Referring to the drawing, there is shown therein a simplified view of only a single one of the many similar winding devices of a textile machine. A winding roller 12 is rotatably mounted on a machine frame. The shaft 13 of the winding roller 12 extends through all the mutually aligned winding devices of the textile machine and is centrally driven through a nonillustrated motor at preferably constant rotary speed.

The winding roller 12 serves for guiding, in the illustrated conventional grooves formed therein, the thread or yarn 14 that is to be wound, and simultaneously for driving the coil 15 which rolls on the winding roller 12 in direction of the arrow 16.

The central coil core 17 of the coil 15 is readily rotatably held by a coil holder 19, of the type generally known from U.S. Pat. Nos. 3,092,340 and 3,131,885, for example which is pivotable about an axis of rotation or shaft 18 so that the coil 15 cannot shift in axial direction. The means for supplying the yarn or thread 14 and other structural details of the textile machine are not shown in the drawing because they are not essential to an understanding of the invention and are, in any event, of conventional contstruction.

At the rear side of the textile machine, shown at the right-hand side of the figure, a profile rail 21 mounted on supports 20 extends along the entire textile machine. Parallel thereto and at the same elevation, a flat rail 22 also is disposed along the entire length of the textile machine. A coil exchanging device 25 travels on rollers 23 and 24 on and along the rails 21 and 22.

The coil exchanging device 25 has a housing 26, a coil withdrawing device 27, a coil storage device 28 and a coil delivery device 29. The coil withdrawing device 27 is formed of a joint pin 30 secured to the housing 26, a coil gripper 31 rotatable about the joint pin 30 and having an actuating lever 32, and a control rod 33 articulatingly secured to the actuating lever 32'.

The coil storage device 28 is formed of two flaps or shutters 34 and 35, which are pivotable outwardly and downwardly and are suspended from hinges 36 and 37 that are connected to the housing 26. In the position in which a coil 59, shown in phantom in the FIGURE, is stored in the coil storage device 28, the flaps 34 and 35 extend substantially horizontally as shown in the FIGURE or even somewhat inclined toward the middle of the storage surface.

The coil delivery device 29 is formed for the most part of a cam disc 38 and a double-arm lever 39, at one end of which a sensing roller or cam follower 40 is rotatably mounted, and at the other arm of which a control rod 41 is articulatingly connected to a second double-arm lever 42. The rotary shafts 43 and 44 of the respective levers 39 and 42 are fixed to the housing 26.

Actuating or control rods 47 and 48 of substantially equal length are suspended from swivel joints 45 and 46 which are located equidistant from the rotary shaft 44 of the lever 42. The control rods 47 and 48 extend to swivel joints 49 and 50, respectively, that are located on the levers 51 and 52, respectively, which are connected to the respective flaps 34 and 35.

An endless conveyor belt 55 guided by rollers 53 and 54 is located below the coil storage device 28 and extends over the entire length of the textile machine. Laterally adjacent the conveyor belt 55, guiding surface members 56 and 57 connected to the machine frame 11 are located.

At the instant the coil 15 has attained the winding size thereof shown in the FIGURE, operation of the winding device is initially halted and the coil exchanging device is then drawn past the winding device and sequentially performs the following operations or working steps by means of a conventional timing mechanism 64.

The coil holder 19 is loosened or released from the coil core 17 and the coil 16 is then seized by the coil gripper 31 and rolled onto the coil storage device 28. This occurs due to the movement of the control rod 33 in direction of the arrow 58.

On the storage device 28, the coil assumes the aforementioned position 59 thereof, shown in phantom. The coil is prevented from rolling backwards i.e. to the right-hand side of the FIGURE, by means of a stop 60 connected to the housing 26.

The cam disc 38 is then set slowly into rotary motion in direction of the arrow 61, preferably released by or resulting from the weight of the coil 15. Due to the special lever and rod arrangement, the double-arm lever 39 is loaded or stressed by the weight per se of the flaps 34 and 35 and the weight of the coil 15 so that the cam follower or sensing roller 40 is pressed against the contour 62 of the cam disc 38 and necessarily follows the contour 62.

Since the cam disc 38 rotates slowly, the flaps 34 and 35 are slowly opened downwardly and outwardly, as viewed in the FIGURE, by means of the aforementioned lever and rod arrangement.

The coil which exerts a load on the flaps 34 and 35 follows this movement and slides initially slowly, then more rapidly downwardly, and finally falls from a low level onto the conveyor belt 55, which transports the coil to the end of the textile machine to a non-illustrated supply container. The coil assumes the position 63 shown in solid lines on the conveyor belt 55.

While the cam disc 38 slowly rotates further until it reaches its initial starting position, the flaps 34 and 35 again, close and the aforedescribed operation can be repeated anew.

The other components and structural members present in the coil exchanging device 25 are not shown in the drawing nor described herein because they are believed to be unnecessary for a clear understanding of the invention. As mentioned hereinbefore, the various operations of releasing the coil holder 19 from the coil core 17, seizing the latter by the gripper 31 and rolling it onto the coil storage device 28 are effected by a conventional timing mechanism 64. As shown diagrammatically in the FIGURE, the timing mechanism or time switch gear 64 of any suitable conventional construction activates a coil holder releasing device 65 of conventional construction, such as of the electromagnetic type as disclosed in U.S. Pat. No. 3,307,794 of S. Fürst, for example, thereby releasing the coil 15. Thereafter, a suitable telechron motor 66 or the like is energized by the timing mechanism 64 to pivot the lever 32' and thereby shift the control rod 33 in direction of the arrow 58 so as to pivot the coil gripper 31 counterclockwise, as viewed in the FIGURE, and thereby roll the coil 15 onto the flaps 34 and 35. At that instant the timing mechanism 64 may be stopped du to a an automatically resetting toggle switch device 67, for example, the flexible blade 67' of which is actuated by the weight of the coil in the phantom position 59 thereof on the flaps 34 and 35, and the timing mechanism 64 reset to the starting position thereof, the coil gripper 31 being, in turn, reset and the coil holder 19 being also reset to hold a new unwound coil core for winding by the respective winding device. Simultaneously, the toggle switch 67 actuated by the weight of the coil in the position 59 causes energization of a motor 68 which rotates the cam disc 38 in direction of the arrow associated therewith. When the coil has slid from the phantom position 59 thereof between the downwardly opened flaps 34 and 35 which can wipe past the flexible blade 67', the cam disc 38 has returned to its starting position and, since the weight of the coil no longer depresses the flexible blade 67', the toggle switch automatically resets to the off position and the motor 68 switches off and the rotation of the cam disc 38 ceases.

There is claimed:

1. Device for withdrawing and transporting a wound coil away from a winding device for textile filaments comprising a traveling coil exchanging device for sequentially servicing a plurality of winding devices, said coil exchanging device including means for withdrawing a wound coil from a respective winding device, coil storage and delivery means for storing therein the coil withdrawn from the respective winding device, said coil storage and delivery means including a closure device secured on said traveling coil exchanging device against vertical displacement relative thereto and openable in a downward direction for discharging the wound coil therefrom, said coil storage and delivery means comprising a mechanism for opening the same to discharge the wound coil stored therein, and including a timing mechanism for controlling said withdrawing means and means actuable by the weight of a wound coil in said coil storage and delivery means for initiating operation of said opening mechanism.

2. Device for withdrawing and transporting a wound coil away from a winding device for textile filaments comprising a traveling coil exchanging device for sequentially servicing a plurality of winding devices, said coil exchanging device including means for withdrawing a wound coil from a respective winding device, coil storage and delivery means for storing therein the coil withdrawn from the respective winding device, said coil storage and delivery means including a closure device secured on said traveling coil exchanging device against vertical displacement relative thereto and openable in a downward direction for discharging the wound coil therefrom, said coil storage and delivery means comprising a mechanism for opening the same to discharge the wound coil stored therein, and including a timing mechanism for controlling said withdrawing means.

3. Device for withdrawing and transporting a wound coil away from a winding device for textile filaments comprising a traveling coil exchanging device for sequentially servicing a plurality of winding devices, said coil exchanging device including means for withdrawing a wound coil from a respective winding device, coil storage and delivery means for storing therein the coil withdrawn from the respective winding device, said coil storage and delivery means including a closure device having support means fixed against vertical displacement with respect to said traveling coil exchanging device and at least one rigid member carried by said support means and formed with a surface whereon a sound coil is supportable, said surface of said rigid member being declinable with respect to said support means so as to open said closure device for discharging the wound coil therefrom said at least one rigid member being a pair of rigid flaps and said fixed support means including respective means for pivoting said flaps downwardly and outwardly in opposite rotary directon.

4. Device for withdrawing and transporting a wound coil away from a winding device for textile filaments comprising a traveling coil exchanging device for sequentially servicing a plurality of winding devices, said coil exchanging device including means for withdrawing a wound coil from a respective winding device, coil storage and delivery means for storing therein the coil withdrawn from the respective winding device, said coil storage and delivery means including a closure device openable in a downward direction for discharging the wound coil therefrom, said closure device comprising pivot means fixed against vertical displacement relative to said coil exchanging device, and a pair of flaps pivotable downwardly and outwardly in opposite rotary directions about said fixed pivot means, said pair of flaps in position thereof wherein a wound coil is stored in said coil storage and delivery means extending substantially in a common horizontal plane.

5. Device for withdrawing and transporting a wound coil away from a winding device for textile filaments comprising a traveling coil exchanging device for sequentially servicing a plurality of winding devices, said coil exchanging device including means for withdrawing a wound coil from a respective winding device, coil storage and delivery means for storing therein the coil withdrawn from the respective winding device, said coil storage and delivery means including a closure device secured against vertical displacement relative to said traveling coil exchanging device openable in a downward direction for discharging the wound coil therefrom, said coil exchanging device being guided in a given travel direction past said plurality of winding devices, and including conveyor belt means extending in said given travel direction below said coil storage and delivery means for receiving and transporting away the wound coil discharged from said coil storage and delivery means.

6. Device according to claim 4 wherein said flaps are slightly inclined toward one another in said position thereof wherein a wound coil is stored in said coil storage and delivery means.

7. Device according to claim 5 wherein said conveyor belt has a conveying speed greater than the speed of travel of said coil exchanging device in said given travel direction.

* * * * *